US006495952B1

(12) United States Patent
Nakamura et al.

(10) Patent No.: US 6,495,952 B1
(45) Date of Patent: Dec. 17, 2002

(54) CATHODE RAY TUBE HAVING AN INTERNAL VOLTAGE-DIVIDING RESISTOR

(75) Inventors: Hisao Nakamura, Mobara (JP); Satoru Miyamoto, Mobara (JP); Atsushi Tsuruoka, Mobara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

(21) Appl. No.: 09/516,202

(22) Filed: Feb. 29, 2000

(51) Int. Cl.[7] ..... H01J 29/48; H01J 3/02
(52) U.S. Cl. ..... 313/446; 313/417
(58) Field of Search ..... 313/446, 417, 313/451, 313, 479; 315/382.1; 361/220, 120

(56) References Cited

U.S. PATENT DOCUMENTS 4,503,357 A * 3/1985 Ouhata et al. ..... 313/313
6,011,349 A * 1/2000 Amano et al. ..... 313/417
6,034,469 A * 3/2000 Uda et al. ..... 313/346 R

FOREIGN PATENT DOCUMENTS

JP 60-1727 1/1985
JP 10-289673 10/1998

* cited by examiner

*Primary Examiner*—Sandra O'Shea
*Assistant Examiner*—Bao Truong
(74) *Attorney, Agent, or Firm*—Antonelli, Terry, Stout & Kraus, LLP

(57) ABSTRACT

A cathode ray tube includes an electron gun having plural focus electrodes and an anode in its neck portion, a voltage-dividing resistor for producing an intermediate voltage applied to a first one of the focus electrodes adjacent to the anode by dividing an anode voltage, a metal conductor attached to a second one of the focus electrodes to surround the voltage-dividing resistor, and a metal film on an insulating substrate of the voltage-dividing resistor between the metal conductor and an intermediate-voltage terminal of the voltage-dividing resistor. The second one of the focus electrodes is disposed upstream of the first one of the focus electrodes, and the metal film extends at least 1 mm axially and is spaced at least 1 mm from the metal conductor.

20 Claims, 7 Drawing Sheets

CATHODE RAY TUBE HAVING AN INTERNAL VOLTAGE-DIVIDING RESISTOR

BACKGROUND OF THE INVENTION

The present invention relates to a cathode ray tube, and in particular to a cathode ray tube having an electron gun employing an internal voltage-dividing resistor.

Color cathode ray tubes used in TV receivers or information terminals, house an electron gun for emitting a plurality (usually three) of electron beams at one end of an evacuated envelope, a phosphor screen formed of phosphors coated on an inner surface of the evacuated envelope at the other end thereof for emitting light of a plurality (usually three) of colors, and a shadow mask which is closely spaced from the phosphor screen and serves as a color selection electrode. The electron beams emitted from the electron gun are deflected to scan the phosphor screen horizontally and vertically to form a rectangular raster by magnetic fields generated by a deflection yoke mounted externally of the evacuated envelope and display a desired image on the phosphor screen.

FIG. 8 is a cross-sectional view for explaining an exemplary configuration of a color cathode ray tube, and in FIG. 8, reference numeral 1 denotes a panel portion, 2 is a neck portion for housing an in-line type electron gun 9, 3 is a funnel portion for connecting the panel portion 1 and the neck portion 2, 4 is a phosphor screen, 5 is a shadow mask, 6 is a mask frame, 7 is a magnetic shield, 8 is a mask suspension mechanism, 10 is a deflection yoke, 11 is an internal conductive coating, 12 is a shield cup, 13 is a contact spring, 14 is a getter and 15 are stem pins.

In this color cathode ray tube, an evacuated envelope is formed by the panel portion 1, the neck portion 2 and the funnel portion 3, and electron beams 16 emitted from the electron gun 9 housed in the neck portion 2 scan the phosphor screen 4 two-dimensionally by being subjected to the horizontal and vertical deflection magnetic fields produced by the deflection yoke 10.

The electron beams 16 are modulated in amount by video signals supplied via the stem pins 15, are color-selected by the shadow mask 5 disposed immediately in front of the phosphor screen 4, and impinge upon the phosphors of the corresponding primary colors to reproduce a desired color image.

Such cathode ray tubes employ a multistage focus lens system to obtain sufficiently small electron beam spots over the entire phosphor screen.

Japanese Patent Application Laid-open No. Hei 10-255682 (laid-open on Sep. 25, 1998), for example, discloses an "extended field lens" serving as a main lens formed by disposing an intermediate electrode between an anode and a focus electrode. FIG. 9 is a schematic longitudinal cross-sectional view of an electron gun of a cathode ray tube disclosed in Japanese Patent Application Laid-open No. Hei 10-255682 and FIG. 10 is a cross-sectional view taken along line X—X of the electron gun shown in FIG. 9. The electron gun is of the extended field lens type comprising three equally spaced coplanar cathodes 309 (one for each electron beam), a first electrode 301, a second electrode 302, a third electrode 303, a fourth electrode 304, a 5-1st electrode (a focus electrode) 305, a 5-2nd electrode (a focus electrode) 306, an intermediate electrode 310, a sixth electrode (an anode electrode) 307 and a shield cup 308 arranged coaxially in the order named from the cathodes 309, and the cathodes and the electrodes are fixed in predetermined spaced relationship on a pair of glass beads 311.

A voltage-dividing resistor 312 fabricated on a ceramic substrate is housed within the cathode ray tube to obtain a voltage to be supplied to the intermediate electrode 310 via a holder pin 313 within the cathode ray tube, and the voltage-dividing resistor 312 is fixed to one of the glass beads 311. A metal wire 314*a* surrounds the glass beads 311 and the voltage-dividing resistor 312 and is welded to the intermediate electrode 310 as shown in FIG. 10.

The electrons emitted from the cathodes 309 are focused by a prefocus lens formed by the cathodes 309, the first electrode 301, the second electrode 302 and the third electrode 303, next by a pre-main lens formed by the third electrode 303, the fourth electrode 304 and the 5-1st electrode 305, and then by a main lens formed by the 5-2nd electrode 306, the intermediate electrode 310 and the sixth electrode 307, onto a phosphor screen, and form an image on the viewing screen of the cathode ray tube.

The voltage applied to the intermediate electrode 310 is selected lower than anode voltage, but higher than voltages applied to the focus electrodes by dividing the anode voltage using the voltage-dividing resistor 312. Provision of the intermediate electrode 310 forms a lens of the extended field type in which the potential distribution along the tube axis is made gentle from the anode electrode to the focus electrodes, reduces spherical aberration and consequently the diameter of the electron beam spots is reduced.

As shown in FIG. 10, the amount of electrical charges accumulated on the inner wall of a neck glass 317 is stabilized by attaching the metal wire 314*a* to the intermediate electrode 310 such that the metal wire 314*a* surrounds the glass bead 311 and the voltage-dividing resistor 312.

After the completed electron gun is inserted into the neck glass 317, a portion of metal contained in the metal wire 314*a* is evaporated to form metal films (not shown) on the inner wall of the neck glass 317 and the surface of the voltage-dividing resistor 312 and the glass bead 311 by heating the metal wire 314*a* using an external high-frequency induction heater such that more stable potential is established on the inner wall of the neck glass 317.

In the manufacture of a cathode ray tube, after the cathode ray tube has been exhausted of gases and sealed, so-called spot-knocking (high-voltage stabilization) of applying a high voltage of about twice the normal operating voltage for the cathode ray tube to its anode is carried out to remove projections in electrodes of the electron gun or foreign particles within the cathode ray tube by forcing arcing between the electrodes and between the electrodes and the inner wall of the neck portion and to thereby prevent occurrence of arcing within the cathode ray tube during the normal operation of the completed cathode ray tube.

But, when high voltages for spot-knocking are applied to electrodes of a cathode ray tube employing the extended field lens formed by applying a voltage divided from the anode voltage using an internal voltage-dividing resistor to the intermediate electrode, arcing occurs between the anode electrode and the above-mentioned metal wire for suppression of discharge, and consequently, voltages sufficiently high for spot-knocking are not generated between the anode electrode and the intermediate electrode adjacent thereto, and between the intermediate electrode and another electrode facing the cathode side of the intermediate electrode, and consequently, there has been a problem in that sufficient effects of spot-knocking are not obtained, and as a result, satisfactory withstand voltage characteristics are not secured within the cathode ray tube.

SUMMARY OF THE INVENTION

It is an object of the present invention to provide a cathode ray tube incorporating an internal voltage-dividing resistor and having withstand voltage characteristics improved by heightening effects of spot-knocking preventing arcing between the electrodes supplied with high voltages and the metal wire for suppression of discharge, during the spot-knocking procedure and thereby solving the above problem.

To accomplish the above object, in accordance with an embodiment of the present invention, there is provided a cathode ray tube comprising: an evacuated envelope comprising a panel portion having a phosphor screen formed on an inner surface thereof, a neck portion and a funnel portion connecting said panel portion and said neck portion; an electron gun housed in said neck portion comprising at least one cathode, a first grid electrode, a second grid electrode, a plurality of focus electrodes and an anode arranged in the order named for focusing at least one electron beam emitted from said at least one cathode on said phosphor screen, said at least one cathode, said first grid electrode, said second grid electrode, said plurality of focus electrodes and said anode being fixed in predetermined axially spaced relationship by at least two glass beads; a voltage-dividing resistor attached to one of said at least two glass beads for producing an intermediate voltage to be applied to a first one of said plurality of focus electrodes adjacent to said anode by dividing a voltage applied to said anode; a metal conductor facing and attached to a second one of said plurality of focus electrodes to surround said voltage-dividing resistor and said one of said at least two glass beads, said second one of said plurality of focus electrodes being disposed upstream of said first one of said plurality of focus electrodes; and a metal film disposed on a side of an insulating substrate of said voltage-dividing resistor facing an inner wall of said neck portion between said metal conductor and an intermediate voltage terminal of said voltage-dividing resistor for applying said intermediate voltage to said first one of said plurality of focus electrodes, said metal film extending at least 1 mm in a direction of a longitudinal axis of said cathode ray tube and being spaced at least 1 mm from said metal conductor.

BRIEF DESCRIPTION OF THE DRAWINGS

In the accompanying drawings, in which like reference numerals designate similar components throughout the figures and in which.

DETAILED DESCRIPTION OF THE PREFERRED EMBODIMENTS

Figure 1:
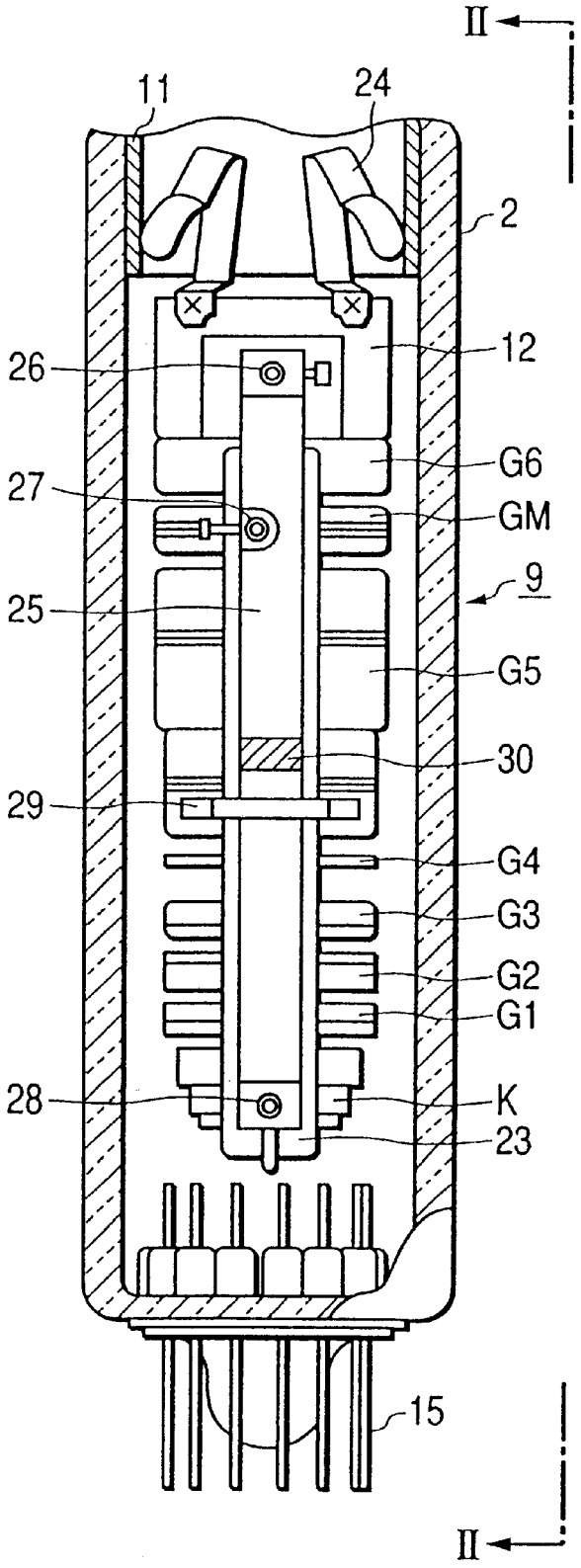
FIG. 1 is a partially broken-away front view of a first embodiment of a color cathode ray tube according to the present invention.

The detailed explanation will be given to the embodiments according to the present invention by reference to the drawings. Like reference numerals denote like or functionally similar parts throughout the figures of the drawings.

Figure 2:
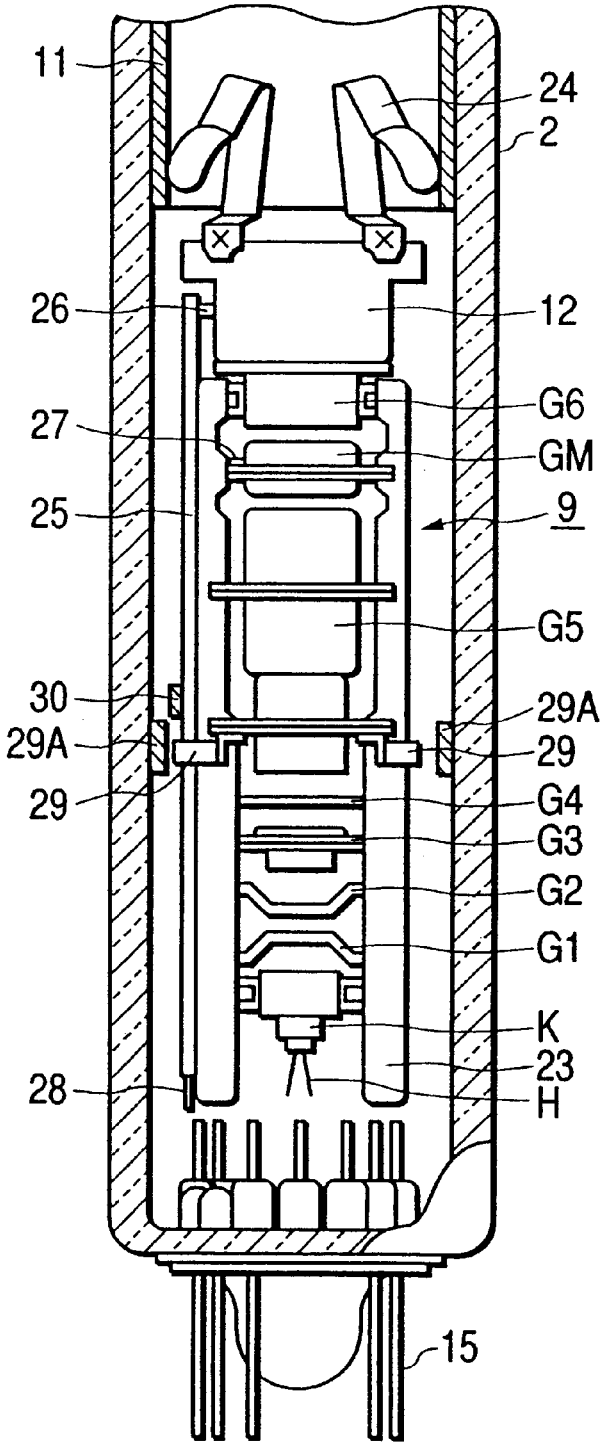
FIG. 2 is a partially broken-away side view of the color cathode ray tube taken along line II—II of FIG. 1.

FIGS. 1 and 2 show the essential part of an electron gun for explaining a first embodiment of a color cathode ray tube according to the present invention, FIG. 1 being a partially cut-away front view of the color cathode ray tube and FIG. 2 being a partially cut-away side view of the color cathode ray tube taken along line II—II of FIG. 1.

The three-beam in-line type electron gun 9 comprises a cathode K, a first grid electrode G1, a second grid electrode G2, a third grid electrode G3, a fourth grid electrode G4, a fifth grid electrode G5, an intermediate electrode GM, and a sixth grid electrode G6. The first to sixth grid electrodes G1–G6 and the intermediate electrode GM are fixed on a pair of glass beads (multiform glass beads) 23 in the predetermined order by embedding peripheral flanges of the grid electrodes and the intermediate electrode or support tabs attached to the grid electrodes and the intermediate electrode in a pair of glass beads 23. Bulb spacers 24 center the axis of the electron gun 9 within the neck portion 2. The electron gun 9 is supported on stem pins 15 via leads (not shown) and the cathodes K are heated by the heaters H contained in the cathodes K.

The internal voltage-dividing resistor 25 is mounted on the side of the glass bead 23 facing the neck portion 2. A high-voltage terminal 26 of the internal voltage-dividing resistor 25 is connected to a shield cup 12 attached to the sixth grid electrode G6, an intermediate-voltage terminal 27 is connected to the intermediate electrode GM, and a low-voltage terminal 28 is grounded via one of the stem pins 15.

A shield wire 29 for suppression of discharge is disposed to surround the internal voltage-dividing resistor 25 and one of the glass beads 23 mounting the resistor 25 and is connected to the fifth grid electrode G5. The shield wire 29 for suppression of discharge can be made from nickel, stainless steel or the like.

A conductive film 29A for suppression of discharge shown in FIG. 2 is formed on the inner wall of the neck portion 2 by evaporating a portion of metal contained in the shield wire 29 onto the inner wall of the neck portion 2 heating the shield wire 29 using a high-frequency induction heater (not shown) external to the neck portion 2 after the spot-knocking step.

Provision of a conductive film 30 for prevention of arcing induced by the shield wire 29 is one of the features of the present invention, and is disposed on the side of the internal voltage-dividing resistor 25 facing the inner wall of the neck portion 2.

Figure 3:
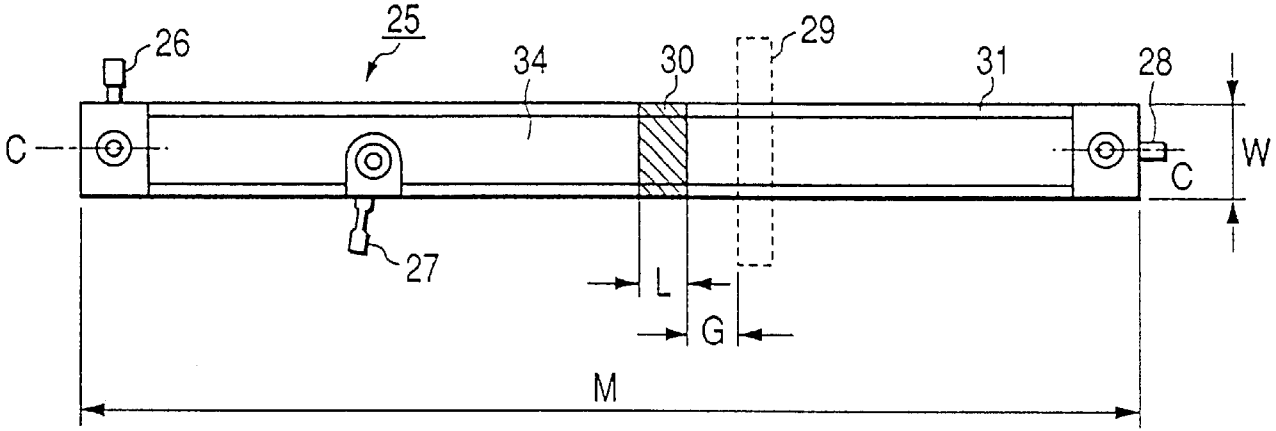
FIG. 3 is a top view of a voltage-dividing resistor used in the color cathode ray tube of the present invention.
Figure 4:
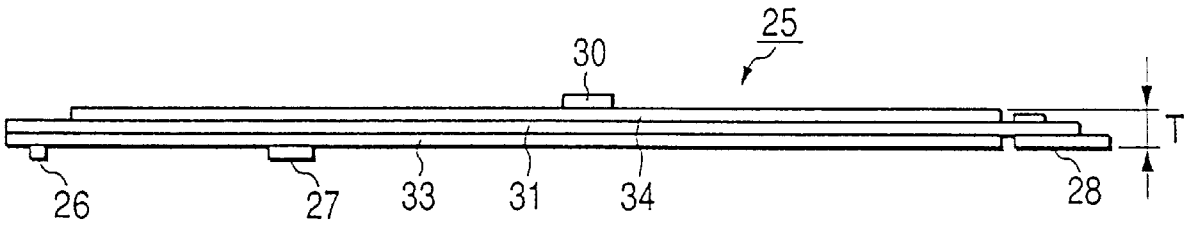
FIG. 4 is a side view of the voltage-dividing resistor of FIG. 3.
Figure 5:
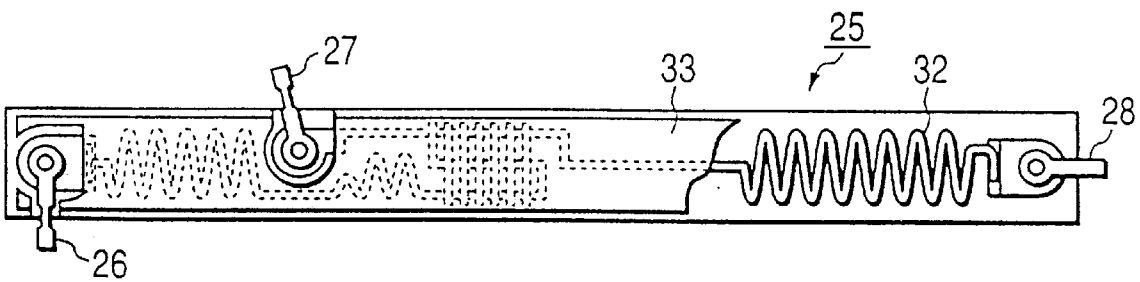
FIG. 5 is a partially broken-away rear view of the voltage-dividing resistor of FIG. 3.

First, the internal voltage-dividing resistor 25 will be explained in detail. FIGS. 3, 4 and 5 are a top view, a side view and a partially broken-away rear view of the voltage-dividing resistor 25, respectively. The internal voltage-dividing resistor 25 comprises a resistance element 32 made chiefly of ruthenium oxide and formed on an alumina ceramic substrate 31, and the high-voltage terminal 26, the low-voltage terminal 28 and the intermediate-voltage terminal 27 disposed at two ends of the resistance element 32, at the point intermediate between the two ends, respectively. The resistance element 32 is covered with an overcoat glass film 33 (made of lead glass, for example), and the top surface of the ceramic substrate 31 is covered with an overcoat glass film 34 (made of lead glass, for example).

The position corresponding to the shield wire 29 for suppression of discharge is indicated by broken lines in FIG. 3.

The ceramic substrate 31 is fabricated by shaping $Al_2O_3$ paste into a desired shape of a desired size and firing it. The thus fabricated substrate 31 itself is porous in the strict sense and, consequently there is likelihood of local concentration of electric fields in the ceramic substrate 31. Therefore the overcoat glass film 34 is formed on the side of the ceramic substrate 31 opposite from the resistance element 32 so as to suppress arcing from the shield wire 29 on which electric charges are concentrated to the resistance element 32 and to thereby prevent the fracture of the voltage-dividing resistor 25 during the normal operation of the completed cathode ray tube.

Generally, the overall length M, the width W and the thickness T of the internal voltage-dividing resistor 25 are approximately in ranges of 50 mm to 100 mm, 5 mm to 10 mm and 1 mm to 2 mm, respectively.

The conductive film 30 for prevention of arcing induced by the shield wire (hereinafter referred to as the arcing-preventive conductive film) is formed on the overcoat glass film 34 by sputtering Au—Pd or Cr which is highly conductive and easy to sputter. The arcing-preventive conductive film 30 is formed by bombarding a target made of Au—Pd or Cr with ions and thereby sputtering Au—Pd or Cr on the overcoat glass film 34 covered with a stainless steel mask having an opening.

The internal voltage-dividing resistor 25 is mounted on the glass bead 23 such that the side of the ceramic substrate 31 on which the resistance element 32 is formed faces toward the glass bead 23, that is, the overcoat glass film 33 faces the glass bead 23.

Figure 6:
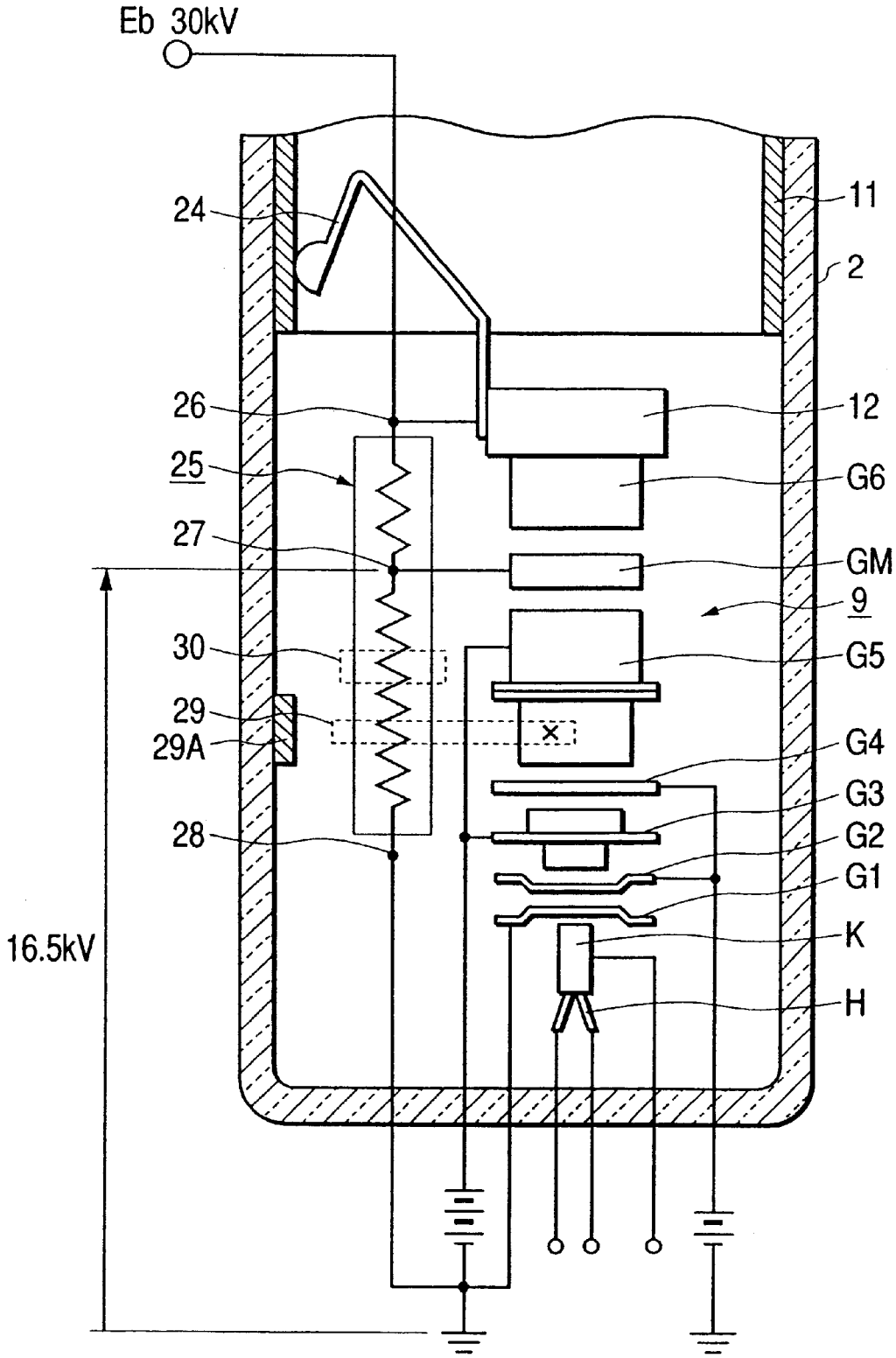
FIG. 6 is a schematic illustration of an electrical configuration for the color cathode ray tube of the present invention of FIG. 1 during operation.

FIG. 6 is a schematic illustration of an electrical configuration for the color cathode ray tube of the present invention of FIG. 1 during operation.

The electrons emitted from the cathode K heated by the heater H are formed into a beam by the first grid electrode G1 (grounded) and the second grid electrode G2 (at 650 V for example), and then they are focused by the third grid electrode G3 (at 7 kV, for example), the fourth grid electrode G4, the fifth grid electrode G5, the intermediate electrode GM and the sixth grid electrode G6 (the anode) to impinge upon the phosphor screen 4.

In the electron gun 9 of this type, the sixth grid electrode G6 is supplied with the anode voltage Eb, a highest voltage (30 kV, for example), the intermediate electrode GM is supplied with a voltage (16.5 kV corresponding to 55% of the anode voltage, for example) divided from the anode voltage Eb using the voltage-dividing resistor 25, the fifth grid electrode G5 and the third grid electrode G3 are connected together within the cathode ray tube and supplied with a same voltage (7 kV, for example), the fourth grid electrode G4 and the second grid electrode G2 are also connected together internally and are supplied with a direct voltage (650 V, for example), and the first grid electrode G1 is grounded. The cathodes K are supplied with video signals, respectively.

In FIG. 6, the shield wire 29 for suppression of discharge attached to the fifth grid electrode G5 and the arcing-preventive conductive film 30 are indicated by broken lines, respectively. The conductive film 29A for suppression of discharge is formed by evaporating a portion of metal contained in the shield wire 29 onto the inner wall of the neck portion 2 by heating the shield wire 29 using a high-frequency induction heater external to the neck portion 2, after the spot-knocking step.

Figure 7:
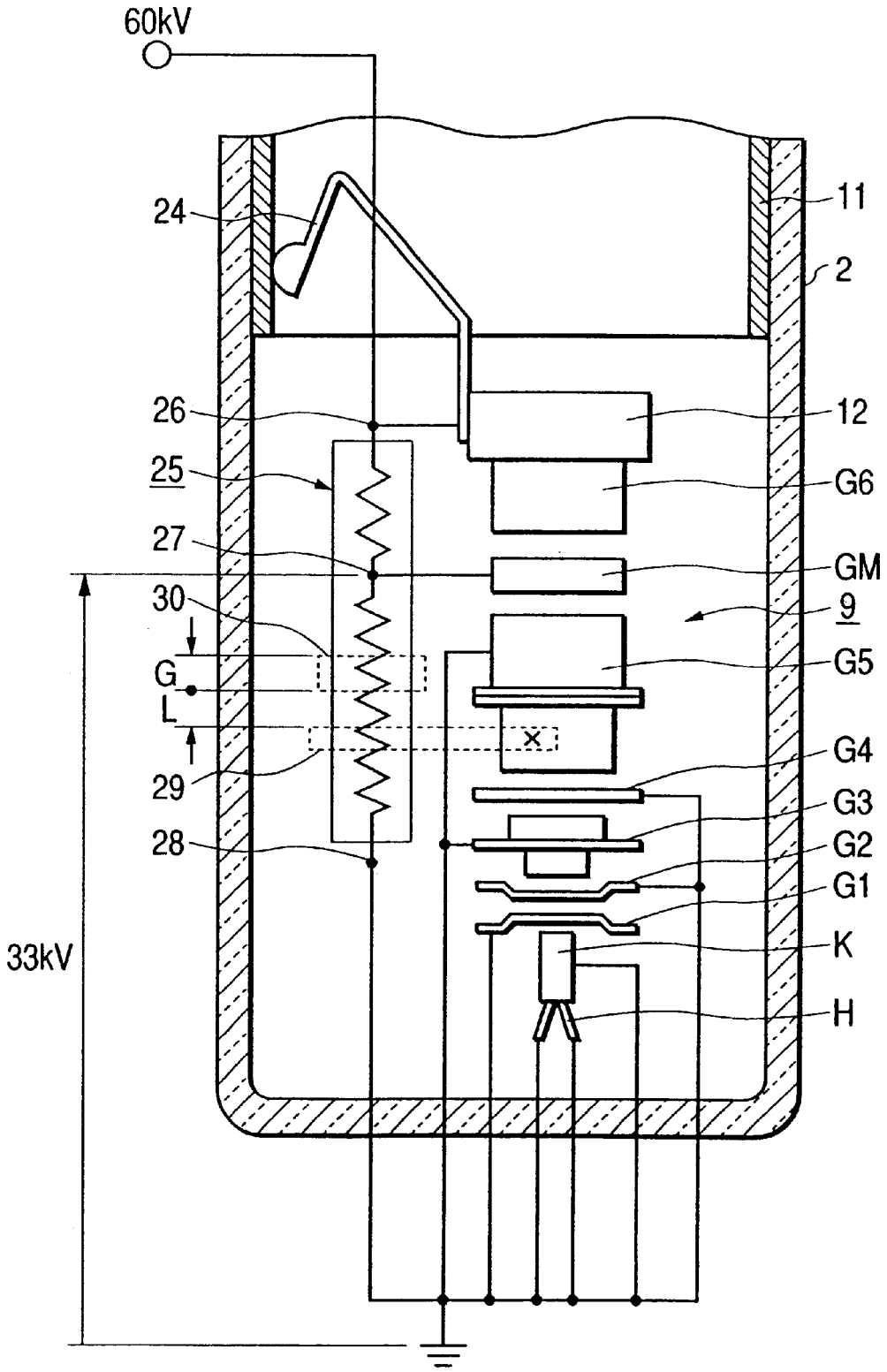
FIG. 7 is a schematic illustration of an electrical configuration for spot-knocking the color cathode ray tube of the present invention of FIG. 1.
Figure 8:
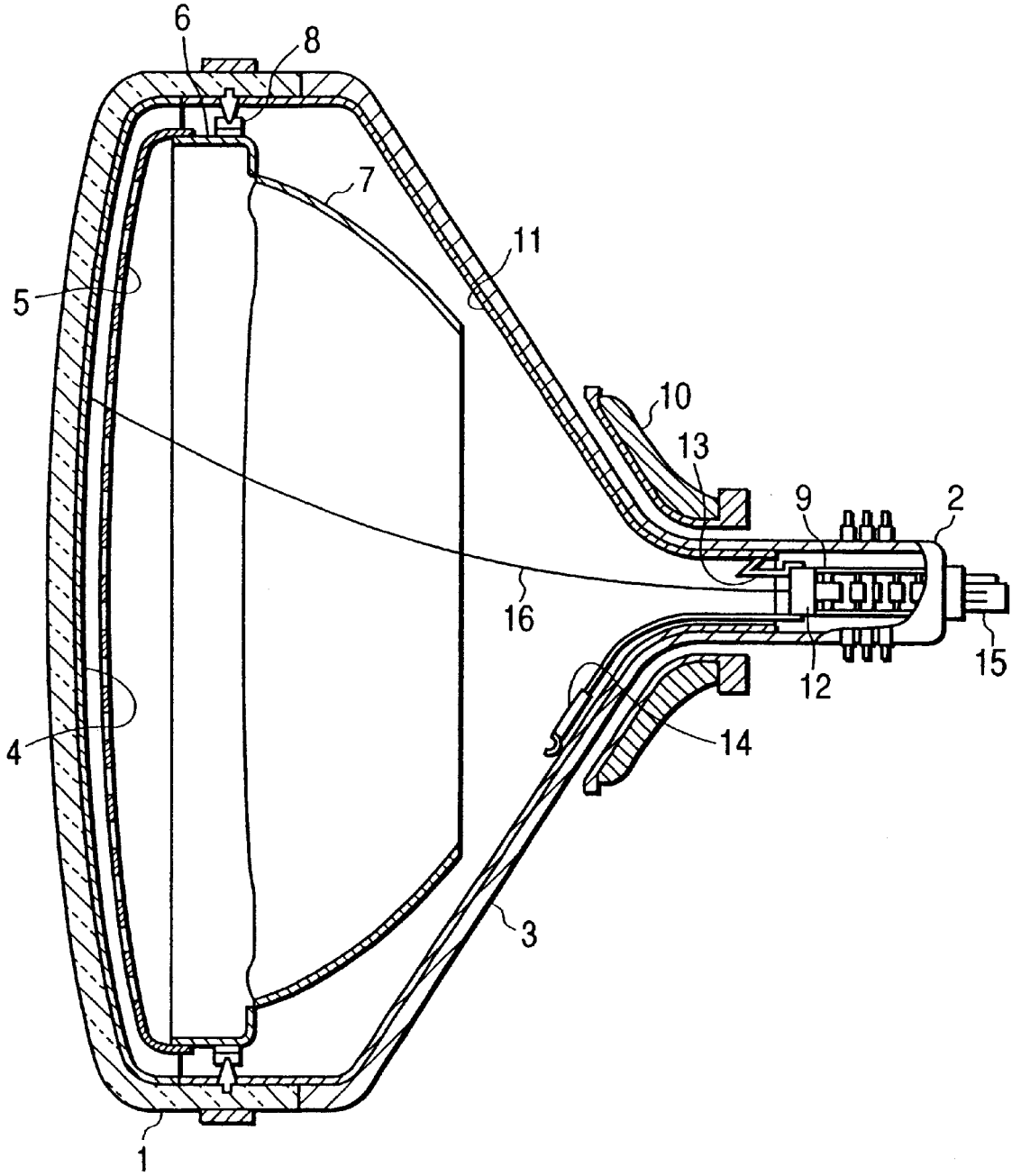
FIG. 8 PRIOR ART
FIG. 8 is a cross-sectional view of an exemplary prior art color cathode ray tube.
Figure 9:
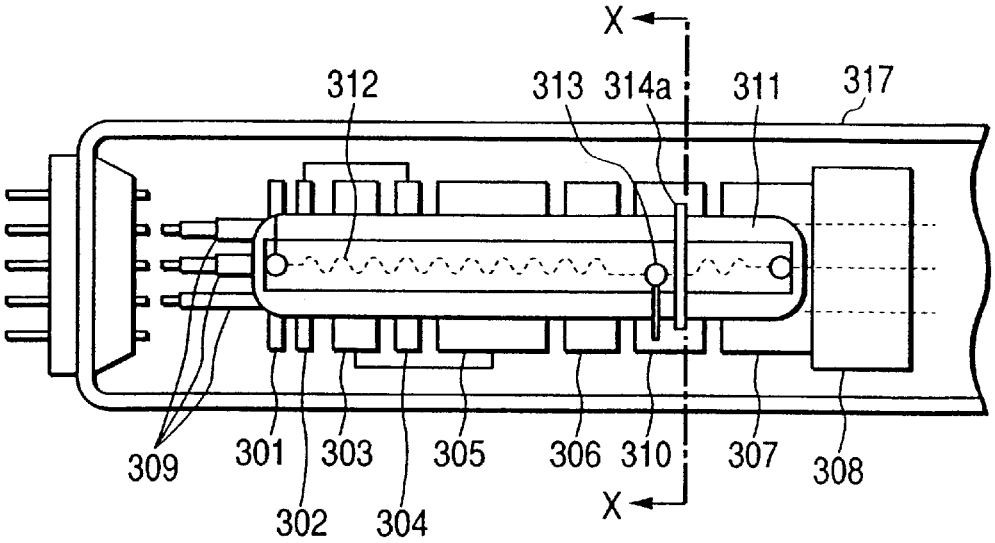
FIG. 9 PRIOR ART
FIG. 9 is a schematic longitudinal cross-sectional view of an electron gun of a prior art cathode ray tube.
Figure 10:
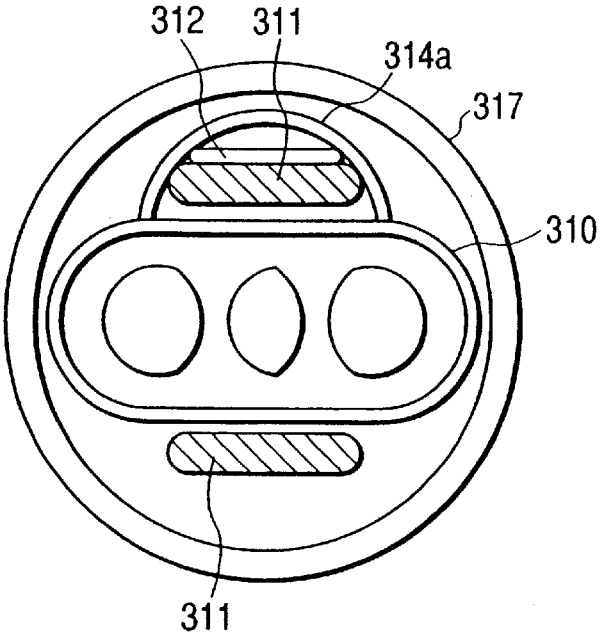
FIG. 10 PRIOR ART
FIG. 10 is a cross-sectional view taken along line X—X of the electron gun of FIG. 9.

The following explains the spot-knocking procedure. FIG. 7 is a schematic illustration of an electrical configuration for spot-knocking the color cathode ray tube of the present invention of FIG. 1 in the manufacturing steps. In the spot-knocking step, the conductive film 29A for suppression of discharge is not formed on the inner wall of the neck portion 2 yet, because the conductive film 29A would be dispersed in the spot-knocking step.

For purpose of comparison, first consider the case where a cathode ray tube does not incorporate the arcing-preventive conductive film 30 in accordance with the present invention. After the cathode ray tube has been exhausted of gases and sealed, all the electrodes except for the sixth grid electrode G6 and the intermediate electrode GM are grounded, a high voltage of 60 kV is applied to the sixth grid electrode G6, and a voltage of 33 kV divided from the high voltage of 60 kV via the voltage-dividing resistor 25 is applied to the intermediate electrode GM.

The purpose of the spot-knocking step is to remove projections in electrodes of the electron gun or foreign particles within the cathode ray tube by forcing arcing between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, by applying 27 kV and 33 kV between the sixth grid electrode G6 and the intermediate electrode GM, and between the intermediate electrode GM and the fifth electrode G5, respectively.

But arcing occurs between the shield wire 29 for suppression of discharge and the sixth grid electrode G6 or the internal conductive coating 11 having the high voltage of 60 kv applied thereto because the fifth grid electrode G5 to which the shield wire 29 is electrically connected is grounded during the spot-knocking step, therefore voltage differences large enough to produce arcing are not obtained between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, and consequently the sufficient effects of the spot-knocking are not obtained.

Now consider the case where a cathode ray tube incorporates the arcing-preventive conductive film 30 in accordance with the present invention as shown in FIG. 7. After the cathode ray tube of the present invention has been exhausted of gases and sealed, all the electrodes except for the sixth grid electrode G6 and the intermediate electrode GM are grounded, the high voltage of 60 kv is applied to the sixth grid electrode G6, and the voltage of 33 kv divided from the high voltage of 60 kV via the voltage-dividing resistor 25 is applied to the intermediate electrode GM.

In the cathode ray tube of the present invention, the electrically floating arcing-preventive conductive film 30 is provided between the sixth grid electrode G6 and the internal conductive coating 11 which are supplied with the high voltage of 60 kV and the shield wire 29 for suppression of discharge which is grounded, and consequently, occurrence of arcing is prevented between the sixth grid electrode G6 and the internal conductive coating 11 which are at the high voltage of 60 kV and the shield wire 29. As a result, 27 kV and 33 kV are applied between the sixth grid electrode G6 and the intermediate electrode GM and between the intermediate electrode GM and the fifth grid electrode G5, respectively, and sufficiently strong arcing is produced between the sixth grid electrode G6 and the intermediate electrode GM, between the intermediate electrode GM and the fifth grid electrode G5, the sixth grid electrode G6 and the inner wall of the neck portion 2, and between the intermediate electrode GM and the inner wall of the neck portion 2, resulting in sufficient removal of projections in electrodes of the electron gun or foreign particles within the cathode ray tube.

An experiment by the present inventors showed that it is necessary to secure the sufficient arcing-preventive effect by the arcing-preventive conductive film 30 that, in FIG. 3, the length L of the arcing-preventive conductive film 30 in the direction of the axis of the cathode ray tube is at least 1 mm as measured on the centerline C—C of the voltage-dividing resistor 25, and the spacing G between the arcing-preventive conductive film 30 and the shield wire 29 for suppression of discharge is at least 1 mm.

After the spot-knocking step, as shown in FIG. 2, the conductive film 29A for suppression of discharge during the normal operation of the completed cathode ray tube is formed on the inner wall of the neck portion 2 by evaporating a portion of metal contained in the shield wire 29 onto the inner wall of the neck portion 2 heating the shield wire 29 using a high-frequency induction heater external to the neck portion 2.

In the above-explained embodiment, the present invention is applied to the three-beam in-line type electron gun, but it is needless to say that the present invention is also applicable to a one-beam electron gun.

The present invention provides the following advantages.

The present invention heightens the effect of the spot-knocking on a cathode ray tube and thereby improves the withstand voltage characteristics of the cathode ray tube during the normal operation of the completed cathode ray tube by disposing a metal film of at least 1 mm in an axial length between an intermediate-voltage terminal and a metal conductor for suppression of discharge and spaced a distance of at least 1 mm from the metal conductor on the insulating film of the internal voltage-dividing resistor facing the inner wall of the neck portion and thereby preventing occurrence of arcing between the metal conductor and the electrodes of the electron gun supplied with high voltages during the spot-knocking procedure.

What is claimed is:

1. A cathode ray tube comprising:

an evacuated envelope comprising a panel portion having a phosphor screen formed on an inner surface thereof, a neck portion and a funnel portion connecting said panel portion and said neck portion;

an electron gun housed in said neck portion comprising at least one cathode, a first grid electrode, a second grid electrode, a plurality of focus electrodes and an anode arranged in the order named for focusing at least one electron beam emitted from said at least one cathode on said phosphor screen, said at least one cathode, said first grid electrode, said second grid electrode, said plurality of focus electrodes and said anode being fixed in predetermined axially spaced relationship by at least two glass beads;

a voltage-dividing resistor attached to one of said at least two glass beads for producing an intermediate voltage to be applied to a first one of said plurality of focus electrodes adjacent to said anode by dividing a voltage applied to said anode;

a metal conductor facing and attached to a second one of said plurality of focus electrodes to surround said voltage dividing resistor and said one of said at least two glass beads, said second one of said plurality of focus electrodes being disposed upstream of said first one of said plurality of focus electrodes; and a metal film disposed on a side of an insulating substrate of said voltage-dividing resistor facing an inner wall of said neck portion between said metal conductor and an intermediate-voltage terminal of said voltage-dividing resistor for applying said intermediate voltage to said first one of said plurality of focus electrodes, said metal film extending at least 1 mm in a direction of a longitudinal axis of said cathode ray tube and being spaced at least 1 mm from said metal conductor.

2. The cathode ray tube according to claim 1, wherein said metal film is a sputtered film made of one of Au—Pd and Cr.

3. The cathode ray tube according to claim 1, wherein said electron gun comprises said at least one cathode, said first grid electrode, said second grid electrode, a third grid electrode, a fourth grid electrode, said first and second ones of said plurality of focus electrodes and said anode arranged in the order named.

4. The cathode ray tube according to claim 3, wherein said second one of said plurality of focus electrodes is electrically connected to said third grid electrode and said fourth grid electrode is electrically connected to said second grid electrode within said cathode ray tube.

5. The cathode ray tube according to claim 2, wherein said electron gun comprises said at least one cathode, said first grid electrode, said second grid electrode, a third grid electrode, a fourth grid electrode, said first and second ones of said plurality of focus electrodes and said anode arranged in the order named.

6. The cathode ray tube according to claim 5, wherein said second one of said plurality of focus electrodes is electrically connected to said third grid electrode and said fourth grid electrode is electrically connected to said second grid electrode within said cathode ray tube.

7. The cathode ray tube according to claim 1, wherein said intermediate voltage is 55% of said voltage applied to said anode.

8. The cathode ray tube according to claim 2, wherein said intermediate voltage is 55% of said voltage applied to said anode.

9. The cathode ray tube according to claim 3, wherein said intermediate voltage is 55% of said voltage applied to said anode.

10. The cathode ray tube according to claim 4, wherein said intermediate voltage is 55% of said voltage applied to said anode.

11. The cathode ray tube according to claim 5, wherein said intermediate voltage is 55% of said voltage applied to said anode.

12. The cathode ray tube according to claim 6, wherein said intermediate voltage is 55% of said voltage applied to said anode.

13. The cathode ray tube according to claim 1, wherein said cathode ray tube further comprises a metal film on an inner wall of said neck portion formed by sputtering a portion of metal contained in said metal conductor.

14. The cathode ray tube according to claim 2, wherein said cathode ray tube further comprises a metal film on an inner wall of said neck portion formed by sputtering a portion of metal contained in said metal conductor.

15. The cathode ray tube according to claim 3, wherein said cathode ray tube further comprises a metal film on an inner wall of said neck portion formed by sputtering a portion of metal contained in said metal conductor.

16. The cathode ray tube according to claim 4, wherein said cathode ray tube further comprises a metal film on an inner wall of said neck portion formed by sputtering a portion of metal contained in said metal conductor.

17. The cathode ray tube according to claim 5, wherein said cathode ray tube further comprises a metal film on an inner wall of said neck portion formed by sputtering a portion of metal contained in said metal conductor.

18. The cathode ray tube according to claim 6, wherein said cathode ray tube further comprises a metal film on an inner wall of said neck portion formed by sputtering a portion of metal contained in said metal conductor.

19. The cathode ray tube according to claim 7, wherein said cathode ray tube further comprises a metal film on an inner wall of said neck portion formed by sputtering a portion of metal contained in said metal conductor.

20. The cathode ray tube according to claim 10, wherein said cathode ray tube further comprises a metal film on an inner wall of said neck portion formed by sputtering a portion of metal contained in said metal conductor.

* * * * *